United States Patent [19]

Patel

[11] Patent Number: 4,979,563

[45] Date of Patent: Dec. 25, 1990

[54] OFFSET SHOCK MOUNTED RECORDER CARRIER INCLUDING OVERPRESSURE GAUGE PROTECTOR AND BALANCE JOINT

[75] Inventor: Dinesh K. Patel, Sugar Land, Tex.

[73] Assignee: Schlumberger Technology Corporation, Houston, Tex.

[21] Appl. No.: 426,903

[22] Filed: Oct. 25, 1989

[51] Int. Cl.[5] ..... G01L 19/00

[52] U.S. Cl. ..... 166/250; 73/706

[58] Field of Search ..... 73/706, 714, 756, 151; 374/143; 166/250

[56] References Cited

U.S. PATENT DOCUMENTS

| | | | |
|---|---|---|---|
| 3,463,010 | 8/1969 | Hatschek | 73/756 X |
| 4,457,180 | 7/1984 | List et al. | 73/706 X |
| 4,715,230 | 12/1987 | Tatsuzawa | 73/706 |

*Primary Examiner*—William P. Neuder

*Attorney, Agent, or Firm*—Henry N. Garrana; John H. Bouchard

[57] ABSTRACT

A shock mounted recorder carrier for a drill stem testing string, adapted for placement in a borehole, includes offset inner and outer bodies for placement of recorders within the carrier and further includes an overpressure gauge protector for protecting a set of recording gauges disposed in the carrier from a well fluid pressure which is greater than a predetermined amount above annulus fluid pressure and a balance joint for providing an oppositely directed force on the recording gauges relative to a direction of flow of the well fluid within the carrier thereby preventing the well fluid pressure from "bottoming out" the shock mount on which the recording gauges are mounted.

14 Claims, 7 Drawing Sheets

OFFSET SHOCK MOUNTED RECORDER CARRIER INCLUDING OVERPRESSURE GAUGE PROTECTOR AND BALANCE JOINT

BACKGROUND OF THE INVENTION

The subject matter of the present invention relates to a recorder carrier for a drill stem testing well tool, and more particularly, to an offset recorder carrier which includes an overpressure gauge protector and a pressure balance joint in addition to a shock mount for protecting the recorders from well fluid pressures greater than a predetermined amount above the well annulus fluid pressure and for preventing the shock mount from bottoming out in response to the well fluid pressure.

Any typical drill stem testing string will include a recorder carrier for carrying pressure recorders or gauges that record the pressure of well fluids being produced from an earth formation in which the testing string is disposed. Since the drill stem testing string is adapted to be lowered into a borehole with an attached perforating gun, when the gun is detonated, a mechanical and a pressure shock is generated, the mechanical shock being transmitted up the testing string. In order to reduce this shock, a shock mount is included as part of the testing string. The pressure recorder is allowed to move up and down with respect to the recorder carrier in order to absorb and dampen the shock transmitted by the tubing string to the pressure recorder. When the shock is received by the recorders in the testing string, the recorders move uphole; however, the shock mount dampens the recorder movement and thereby prevents the recorder from being damaged as a result of the shock. If the high pressure generated due to detonation of the guns exceeds the pressure capacity of the gauge, the recorder gauges are irreversibly damaged.

Furthermore, accuracy in measurement of the well bore annulus fluid pressure is very critical. Therefore, pressure gauges that have a pressure capacity approximately equal to the well bore annulus fluid pressure are used downhole in the wellbore. Error is introduced in pressure measurements by running a high pressure capacity gauge into a low pressure well. However, during a drill stem testing operation, the tubing pressure or well fluid pressure is significantly higher than the well bore annulus fluid pressure, especially during special operations such as stimulation, internal pressure testing of tubing string, and detonation of perforating guns by pressurizing the tubing fluid. The accuracy of a pressure measurement during such special operations is not critical. An ideal situation would include using a high capacity gauge to measure well bore fluid (tubing) pressure during the above referenced special operations and a low capacity gauge to measure well bore annulus fluid pressure. However, this is not possible since all gauges are exposed at all times to the tubing (well bore) pressure. To be more specific, a pressure recorder, when mounted on the exterior of the recorder carrier, is exposed to both the well annulus fluid pressure and the well bore fluid pressure (tubing pressure). Changes of these pressures will exert either a downward or an upward force and move the recorder either up or down, respectively, in relation to the recorder carrier. The recorder will bottom out on the carrier at its upper end when the well bore fluid pressure is higher than the annulus pressure. On the other hand, the recorder will bottom out on the carrier at its downward end when the annulus pressure is higher than the well bore pressure. If the recorder bottoms out due to pressure, the shock mount becomes useless. The recorder will then be damaged due to mechanical shock even if it is shock mounted.

Furthermore, the recorder is often housed in a circumferential annular area around an inner tube of the testing string. If the outside diameter is not increased, the circumferential annular area is sometimes too small to house certain types of required pressure recorder gauges.

SUMMARY OF THE INVENTION

Accordingly, it is a primary object of the present invention to provide a recorder carrier for a drill stem testing string which includes an overpressure protection means for protecting the recorder gauge from well fluid pressures which are greater than a predetermined amount above the well annulus fluid pressure.

It is a further object of the present invention to provide a recorder carrier for a drill stem testing string which includes a balance joint for providing an oppositely directed force on the recorder carrier, relative to a direction of flow of a well fluid in the testing string, in order to prevent a shock mount, on which the recorder carrier is mounted, from bottoming out in response to a pressure of such well fluid in the testing string.

It is a further object of the present invention to provide a recorder carrier outer diameter which is offset in relation to the recorder carrier inner diameter in order to provide more space for placement of the recorders in a circumferential annular space of the recorder carrier without increasing the outside diameter of the carrier.

These and other objects of the present invention are accomplished by providing a recorder carrier which includes an inner tube, an outer tube offset in relation to the inner tube thereby providing a circumferential annular space around the periphery of the inner tube, one portion of the annular space being greater in volume than another portion of the annular space. At least two recorders are placed in the one portion of the annular space. A shock mount is placed on one end of the annular space to dampen the impact of received mechanical shock vibrations. An overpressure gauge protector is placed on the other end of the annular space to protect the recorders from well fluid pressure greater than a predetermined amount above annulus fluid pressure. A pressure balance joint is placed between the overpressure gauge protector and the two recorders for providing an oppositely directed force, relative to a direction of flow pressure of the well fluid within the recorder carrier, thereby compensating for the pressure of the well fluid on the recorders in the carrier and preventing the shock mount, on which the recorders are mounted, from bottoming out in response to the pressure of the well fluid on the recorders in the carrier.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
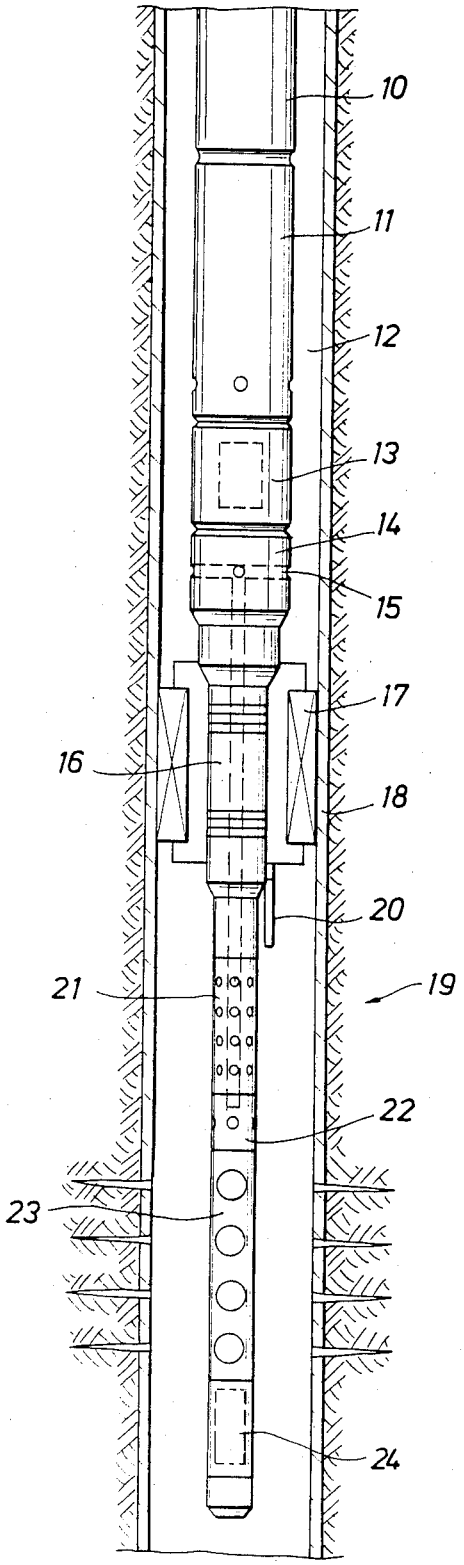
FIG. 1 (PRIOR ART)
FIG. 1 illustrates a schematic view of a typical well perforating and testing system disposed in a well.

Referring to FIG. 1, a prior art well perforating and testing system is illustrated. This well perforating and testing system is discussed fully in U.S. Pat. No. 4,509,604 to Upchurch, entitled "Pressure Responsive Perforating and Testing System", the disclosure of which is incorporated by reference into this specification. The element numerals found in U.S. Pat. No. 4,509,604 will also be used in FIG. 1.

Referring to FIG. 1, a typical prior art perforating and testing system is illustrated. In FIG. 1, a string of formation testing and perforating tools 19 is suspended in a cased well bore on a pipe string 10. The tool string 19 includes a main test valve assembly 11 of the type shown in Nutter U.S. Pat. No. Re. 29,638 that includes a valve element which responds to changes in the pressure of fluids in the annulus 12 in order to open and close a flow passage extending upwardly through the valve assembly. The lower end of the main test valve assembly 11 is connected to a sub 13 that houses a pressure recorder which records the pressure of fluids in the passage as a function of elapsed time as the test proceeds. The lower end of the recorder sub 13 is connected to a pressure transfer sub 14 having lateral ports 15 in communication with the well annulus, and the transfer sub is connected to a seal nipple 16 which extends downwardly through the bore of a packer 17 of conventional construction. The packer 17, which can be a permanent set device, typically includes normally retracted slips and packing element which can be expanded to provide an anchored packoff in the well casing 18. The mandrel of the packer has a seal bore which receives the seal nipple 16, and an upwardly closing valve element such as a flapper element 20 serves to automatically close the bore to upward flow of fluids when the seal nipple and components therebelow are withdrawn. A slotted tail pipe 21 is connected below the seal nipple 16 and functions to enable formation fluids to enter the flow passage through the tools when the valve element included in the main test valve assembly 11 is open. The lower end of the tail pipe 21 is connected to a hydraulically operable firing sub 22 that is constructed in accordance with the present invention. The firing sub 22 is arranged to cause the selective operation of a perforating gun 23 which is connected to its lower end, the gun including a number of shaped charge devices that, upon detonation, provide perforations through the wall of the casing 18 and into the formation to enable connate formation fluids to enter the well bore. Another recorder sub 24 may be connected to the lower end of the perforating gun 23 to provide for additional pressure records.

Figure 2:
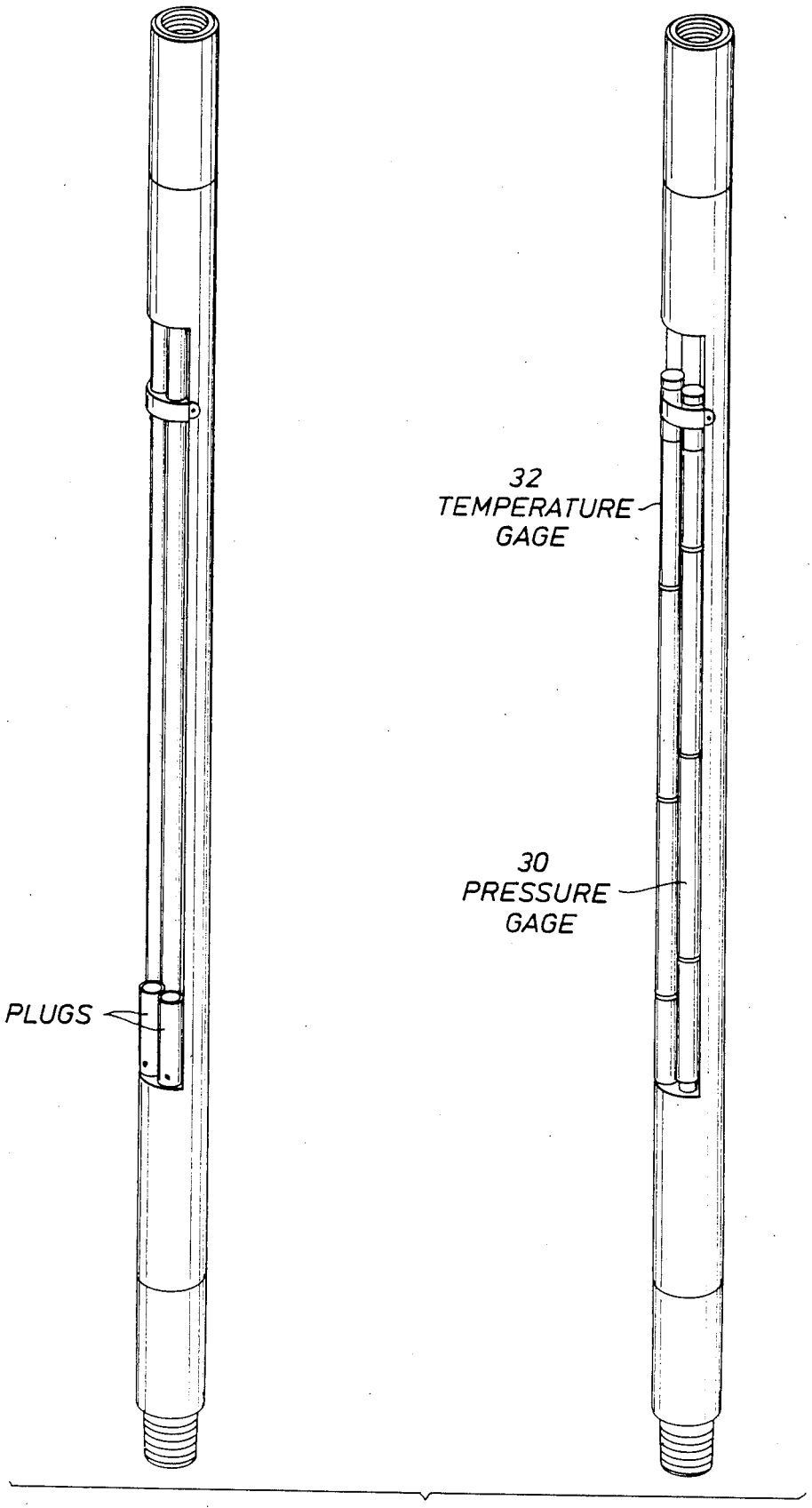
FIG. 2 (PRIOR ART)

Referring to FIG. 2, a prior art recorder carrier housed in recorder subs 13 and/or 24 is illustrated. In FIG. 2, the recorder carrier of the prior art includes a plurality of pressure gauges serially connected together and a plurality of temperature gauges 32 serially connected together, the pressure gauges 30 and temperature gauges 32 being located and housed in an annular circumferential area disposed around the periphery of the recorder carrier of FIG. 2. However, this recorder carrier embodiment of the prior art cannot house $1\frac{1}{4}$ inch outer diameter (OD) gauges since the outer diameter (OD) of the carrier is too small. The OD of the recorder carrier must be increased to a diameter above five (5) inches in order to house the $1\frac{1}{4}$ inch OD gauges. On the other hand, it is necessary that the OD of the recorder carrier be less than or equal to five inches in order to provide adequate clearance for retrieving the recorder carrier subs 13 and/or 24 from within the drill stem testing string of FIG. 1.

Figure 3:
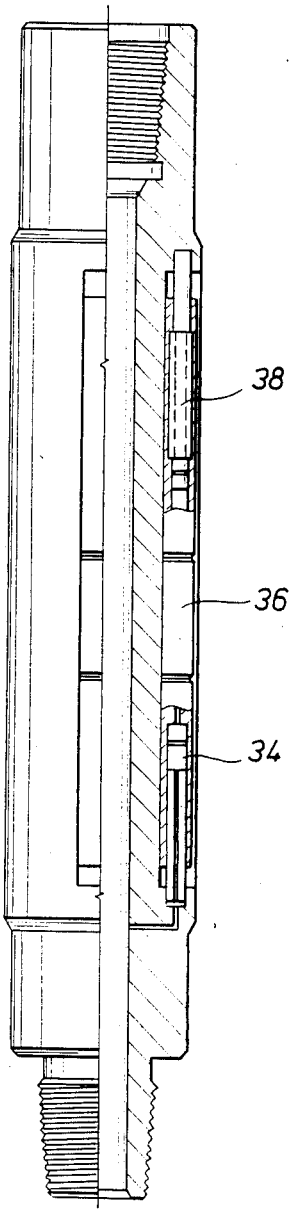
FIG. 3 (PRIOR ART)
FIGS. 2–5 illustrate prior art recorder carriers.
Figure 4:
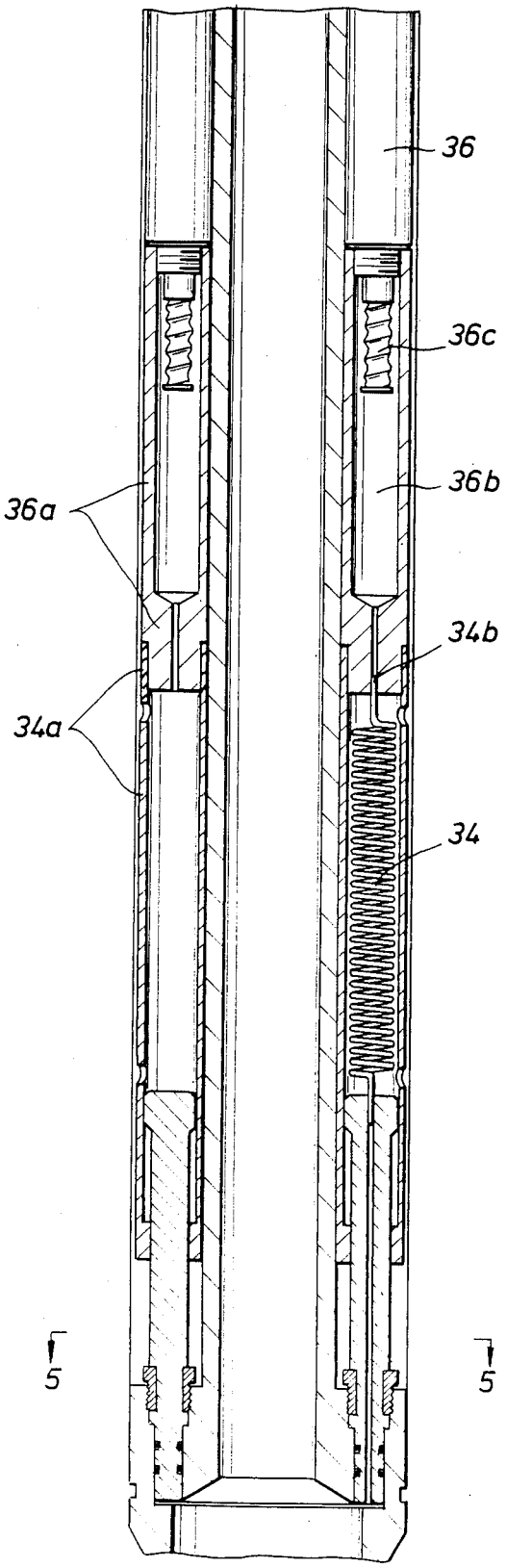
FIG. 4 (PRIOR ART)
Figure 5:
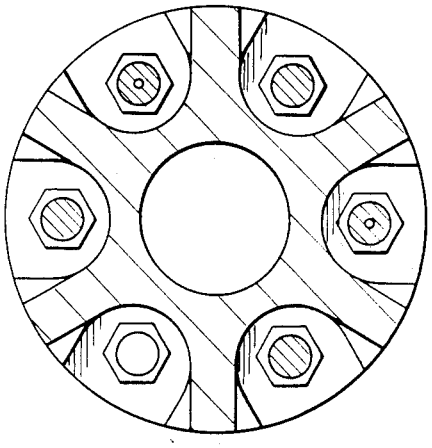
FIG. 5 (PRIOR ART)

Referring to FIGS. 3–5, another prior art embodiment of a recorder carrier housed in the recorder subs 13 and/or 24 of FIG. 1 is illustrated.

In FIG. 3, the recorder carrier of the prior art includes a buffer tube 34, pressure and/or temperature gauges 36, and a shock absorber 38. The shock absorber 38 is designed to absorb a mechanical shock originating from a section of the tool string which houses a perforating gun, the shock being produced when the perforating gun detonates.

In FIG. 4, the buffer tube 34 is shown as being connected to the gauges 36. The gauges 36 are connected to a gauge housing 36*a*. The buffer tube 34 is connected to a buffer tube housing 34*a*. The gauge housing 36*a* is movable with respect to the buffer tube housing 34*a*. The buffer tube 34 comprises a small diameter tubing which is helically arranged in the form of a coil. The one end 34*b* of the buffer tube 34 coiled tubing, which is connected to the gauge housing 36*a*, is movable with respect to the buffer tube housing 34*a* when the gauge housing 36*a* moves with respect to the same buffer tube housing 34*a*. The buffer tube 34 coiled tubing receives a well fluid, the well fluid flowing within the coiled tubing of the buffer tube 34 toward the one end 34*b* of the buffer tube 34. The well fluid exits the one end 34*b* of the buffer tube 34 and enters a space 36*b*, eventually impacting a bellows end 36*c* of the gauges 36. The bellows end 36*c* contracts in response to the well fluid pressure, the degree of contraction being proportional to the pressure of the well fluid. The well fluid pressure is recorded on the gauges 36. This embodiment suffers from two problems: (1) the pressure gauge is, at all times, exposed to the well bore fluid pressure; in order to perform specific operations, such as stimulations, tubing string pressure testing, and detonating the perforating guns by pressurizing the tubing fluid, the pressure capacity of the gauge must be adequate to withstand the high pressures required to perform the above referenced operations without damaging the gauge sensor; the accuracy of the pressure measurement depends on the full scale range (capacity) of the pressure sensor; the embodiment of FIG. 4 fails to completely satisfy these requirements; and (2) the buffer tube assembly is not perfectly pressure balanced, in that high pressure may cause the shock absorber to "bottom out" thereby preventing it from proper functioning.

In FIG. 5, a cross section of the recorder carrier of FIG. 4, taken along section lines 5—5 of FIG. 4, is illustrated.

Figure 6:
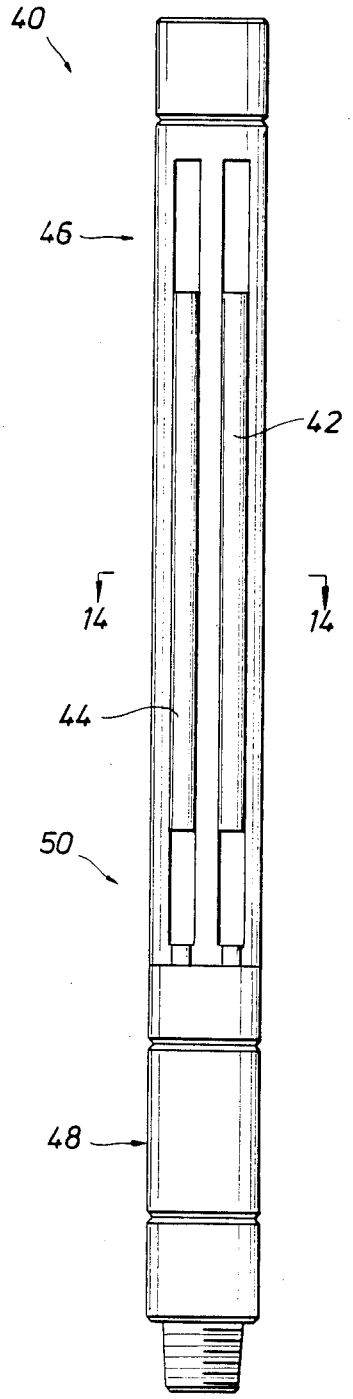
FIG. 6 illustrates a recorder carrier in accordance with the present invention.

Referring to FIG. 6, a schematic of a recorder carrier 40 according to the present invention, housed within recorder subs 13 and/or 24 of FIG. 1, is illustrated.

In FIG. 6, the recorder carrier 40 includes a first recorder 42 and a second recorder 44, each recorder 42 and 44 including at least a pressure gauge for measuring and recording the pressure of well fluid flowing within the recorder carrier which originated from an earth formation following perforation thereof by the perforating gun; a shock mount 46 disposed on one end of the recorders 42 and 44 for absorbing mechanical shock caused by detonation of the perforating gun; an overpressure gauge protector 48 for precluding flow of well fluid within the recorder carrier 40 when the well fluid pressure is greater than or equal to a predetermined amount above well annulus fluid pressure; and a balance joint 50 disposed between the overpressure gauge protector 48 and the recorders 42 and 44 for directing a force in a direction opposite to the direction of a force associated with the pressure of the well fluid originating from the overpressure gauge protector 48 and being exerted on the recorders 42 and 44, the oppositely directed force preventing the shock mount 46 from "bottoming out" in response to the pressure of the well fluid originating from the gauge protector 48 and being exerted on the recorders 42 and 44. In FIG. 6, a balance joint 50 is associated with each recorder 42 and 44, although the overpressure gauge protector 48 comprises a single structure which serves each balance joint 50. A shock mount 46 is also associated with each recorder 42 and 44.

Figure 7:
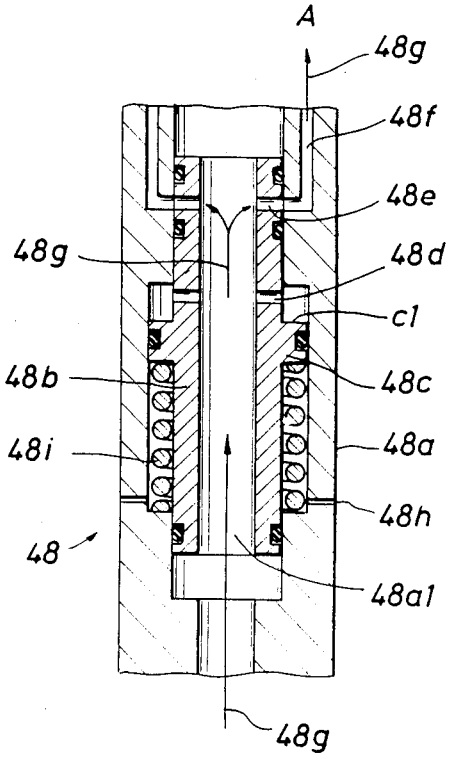
FIG. 7 illustrates the over-pressure gauge protector module of FIG. 6.

Referring to FIG. 7, a basic construction of the overpressure gauge protector 48 in accordance with one embodiment of the present invention is illustrated.

Figure 13A:
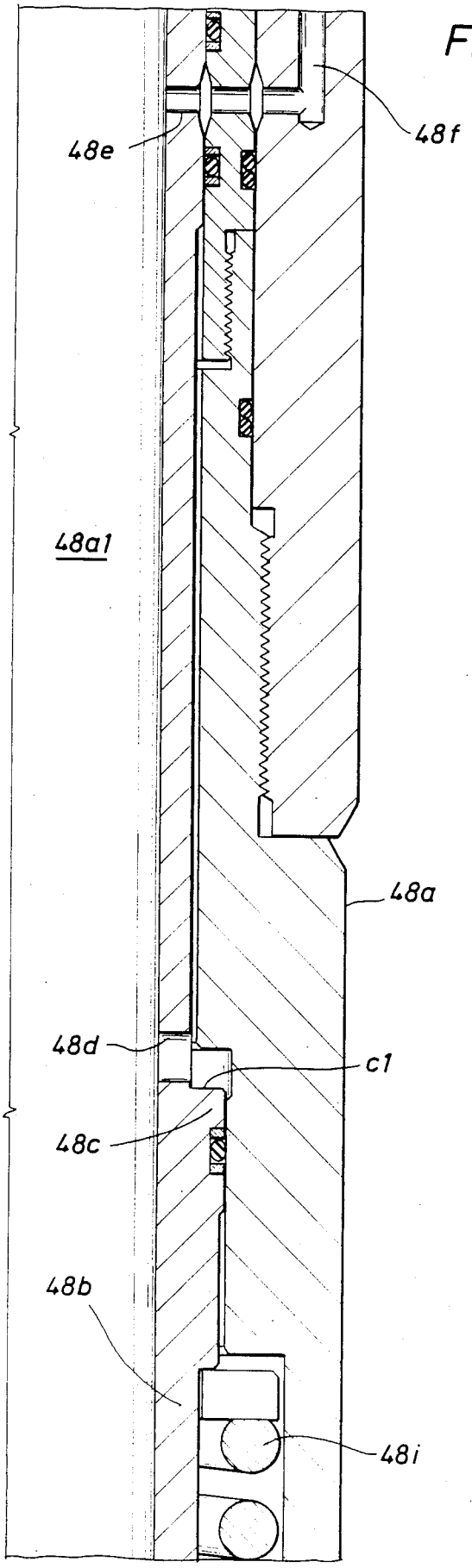
FIGS. 13*a* and 13*b* illustrate in more detail the over-pressure gauge protector of FIG. 7.
Figure 13B:
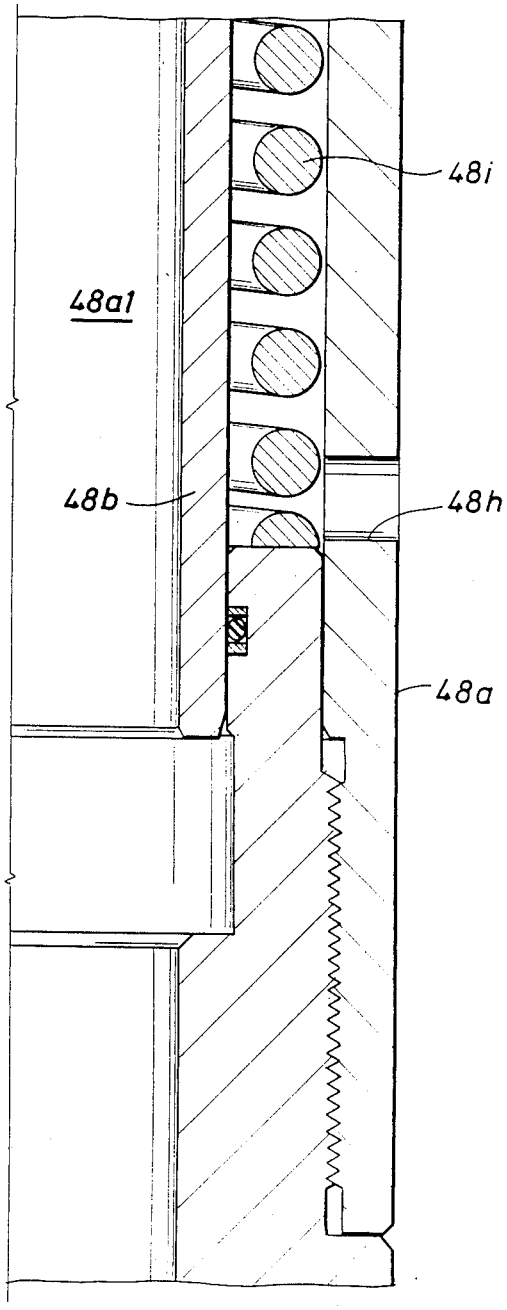

Referring to FIGS. 13*a* and 13*b*, a more detailed construction of the overpressure gauge protector 48 is illustrated, using the same element numerals used in connection with FIG. 7.

In FIGS. 7, 13*a* and 13*b*, the overpressure gauge protector 48 includes an outer housing 48*a*, a mandrel 48*b* having an internal chamber 48*a*1, a piston 48*c* integrally connected to the mandrel 48*b*, a first port 48*d* communicating the internal chamber 48*a*1 of the housing 48*a* with a top surface c1 of the piston 48*c*, a first channel 48*f* in the outer housing 48*a*, a second port 48*e* communicating the internal chamber 48*a*1 with the first channel 48*f* of the outer housing 48*a*, and a third port 48*h* communicating a well annulus area (the area between the drill stem testing string and the borehole wall) with an annular area within the overpressure gauge protector between the mandrel 48*b* and the outer housing 48*a* and beneath the bottom surface of the piston 48*c*. A spring 48*i* is disposed in such annular area and biases the piston 48*c* upwardly in the drawing. A well fluid, originating from an earth formation following perforation, is allowed to flow within the internal chamber 48*a*1, as indicated by the arrow 48*g*.

The functional operation of the overpressure gauge protector 48 will be set forth in the following paragraph with reference to FIGS. 7, 13*a* and 13*b*.

The well fluid 48*g* flows within the internal chamber 48*a*1, having originated from an earth formation following perforation thereof by the perforating gun. The well fluid 48*g* flows into the first port 48*d*, a first force representing the pressure of the well fluid being exerted on the top surface c1 of the piston 48*c*. In the meantime, other well fluid, disposed within the well annulus area, flows into the third port 48*h*, a second force representing the pressure of the other well fluid being exerted on the bottom surface of the piston 48*c*. A third force representing the spring 48*i* force is exerted on the bottom surface of piston 48*c*. If the first force exerted on the top surface c1 of piston 48*c* by the pressure of the well fluid 48*g* is greater than the second force exerted on the bottom surface of the piston 48*c* by the pressure of the other well fluid from the well annulus area plus the third force exerted on the bottom surface of the piston 48*c* by the spring 48*i*, the mandrel 48*b* moves downwardly in the figures. When this happens, the second port 48*e* moves out of alignment with the channel 48*f*. As a result, well fluid from the formation cannot flow in channel 48*f*. As will be shown later in this specification, channel 48*f* communicates with the recorders 42 and 44; therefore, when the pressure of the well fluid is greater than a predetermined amount (the predetermined amount being defined by the force of spring 48*i* on the bottom surface of piston 48*c*) above the well annulus fluid pressure, this excessive well fluid pressure cannot damage the recorders 42 and 44.

Figure 8:
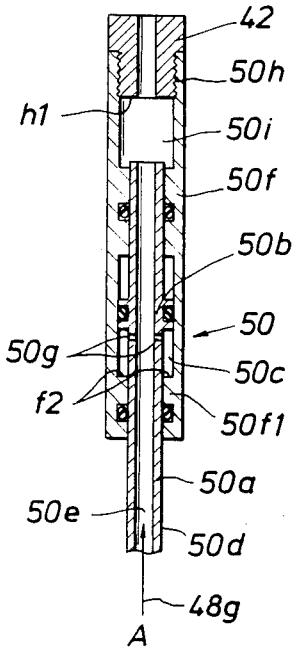
FIG. 8 illustrates the balance joint of FIG. 6.

Referring to FIG. 8, a basic construction of the balance joint 50 in accordance with another embodiment of the present invention is illustrated.

Figure 10A:
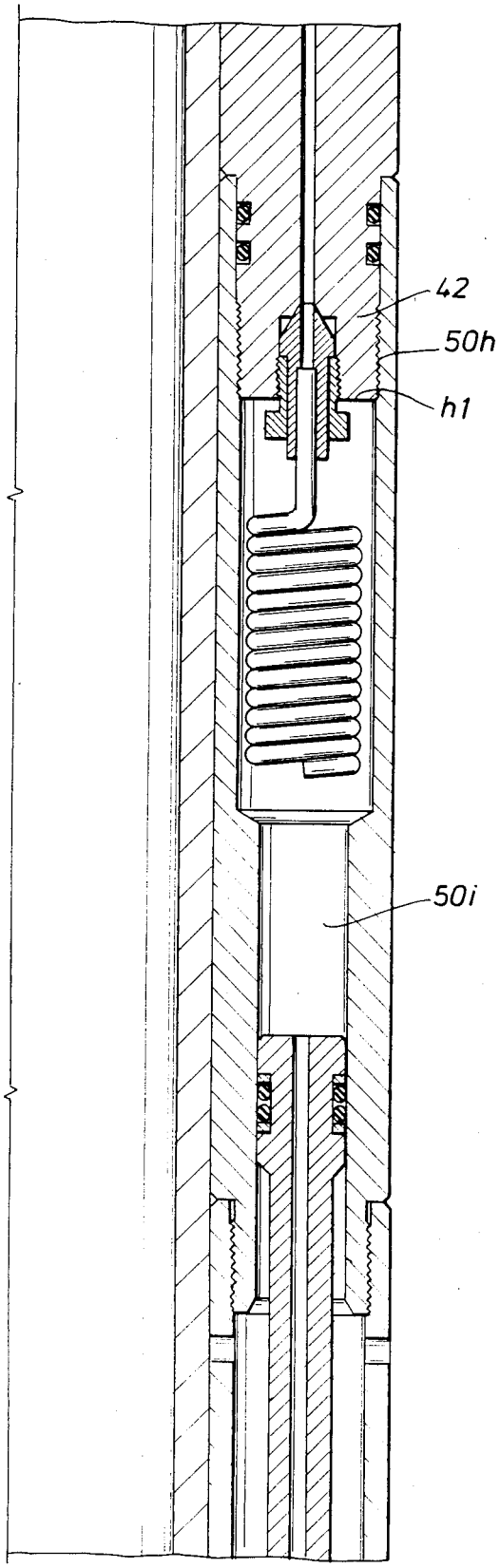
FIGS. 10*a* and 10*b* illustrate in more detail the balance joint of FIG. 8.
Figure 10B:
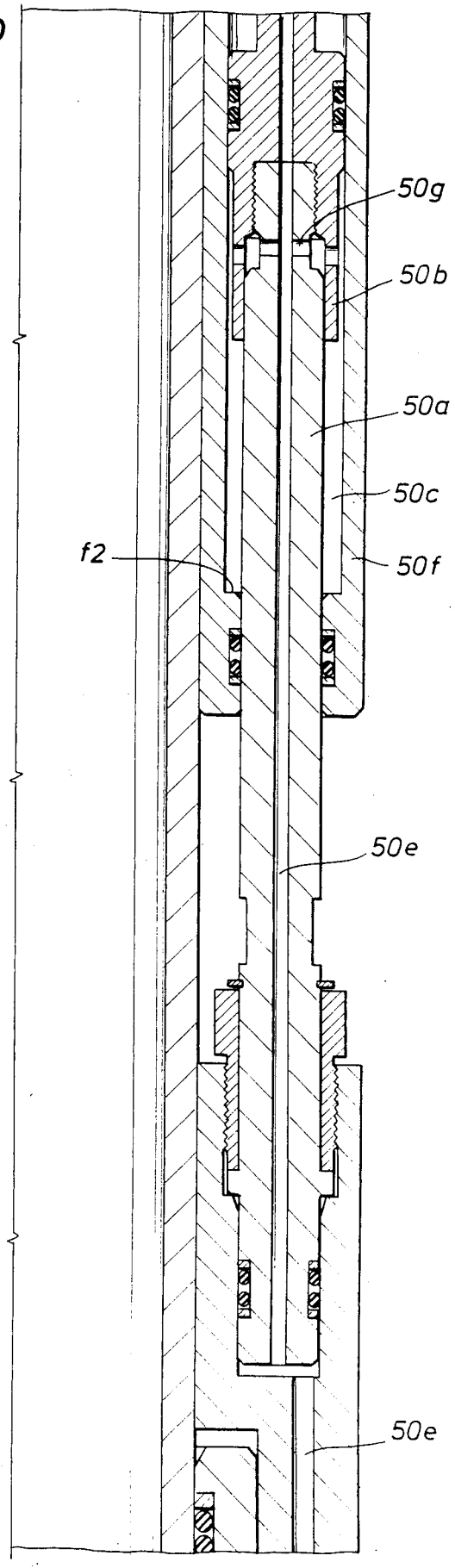

Referring to FIGS. 10*a* and 10*b*, a more detailed construction of the balance joint 50 is illustrated using the same element numerals used in connection with FIG. 8.

In FIGS. 8, 10*a* and 10*b*, the balance joint 50 includes a mandrel 50*a* having a piston 50*b* which slides within an annular area 50*c*. The annular area 50*c* is created when a balance housing 50*f* is disposed around and slidable over the mandrel 50*a*. One end of the balance housing 50*f* includes an enlarged end portion 50*f*1 which snugly contacts, in sealing engagement with, the outer periphery of the mandrel 50*a*. The enlarged portion 50*f*1 includes an upper working surface f2. The mandrel 50*a* has a hollow interior 50*e*. A port 50*g* allows the hollow interior 50*e* of the mandrel 50*a* to communicate with the annular area 50*c* in which the working surface f2 of the enlarged portion 50*f*1 is located. The hollow interior 50*e* of mandrel 50*a* associated with one end of the balance joint 50 communicates with the channel 48*f* of the overpressure gauge protector 48 of FIG. 7, as indicated by the arrow (A) in FIG. 7 and in FIG. 8. The other end of the balance joint 50, and more particularly, the other end of the balance housing 50*f* is connected to one of the recorders (42 or 44) at 50*h*, so as to define an internal chamber 50*i*.

Figure 11:
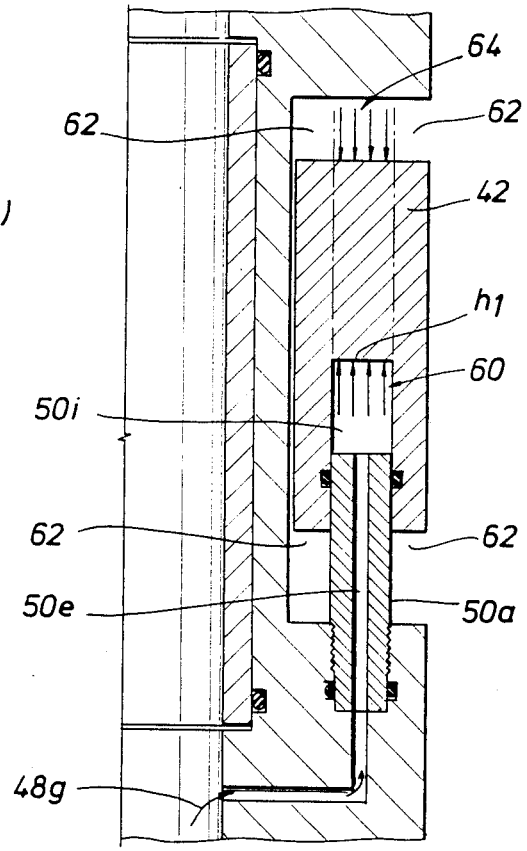
FIG. 11 (PRIOR ART)
FIG. 11 illustrates a prior art recorder carrier which does not include the balance joint of FIGS. 8, 10*a*, 10*b* and its basic principle of operation.

Referring to FIG. 11, a prior art recorder carrier is illustrated which does not include the balance joint 50.

In FIG. 11, a well fluid 48g flows through a hollow interior 50e of a mandrel 50a, and eventually flows into an internal chamber 50i where it exerts its pressure directly onto a recorder 42. No annular area 50c exists, as it does in relation to FIG. 8, 10a/10b. The full force of the well fluid 48g pressure is exerted on the recorder 42, as indicated by arrows 60. Annulus fluid pressure is exerted on both sides of the recorder 42, and at least some of the annulus fluid pressure, exerted on both sides of the recorder 42, cancel out as indicated by the equal areas 62. A net difference in annulus fluid pressure tends to force the recorder 42 to move from top to bottom in FIG. 11, as indicated by arrows 64. However, since no annular area 50c exists, as it does in relation to FIG. 8, 10a/10b, the full force of the well fluid 48g pressure on recorder 42, as indicated by arrows 60, tends to move the recorder 42 from bottom to top in the figure, which movement may, in turn, cause the recorder to "bottom out".

Figure 12:
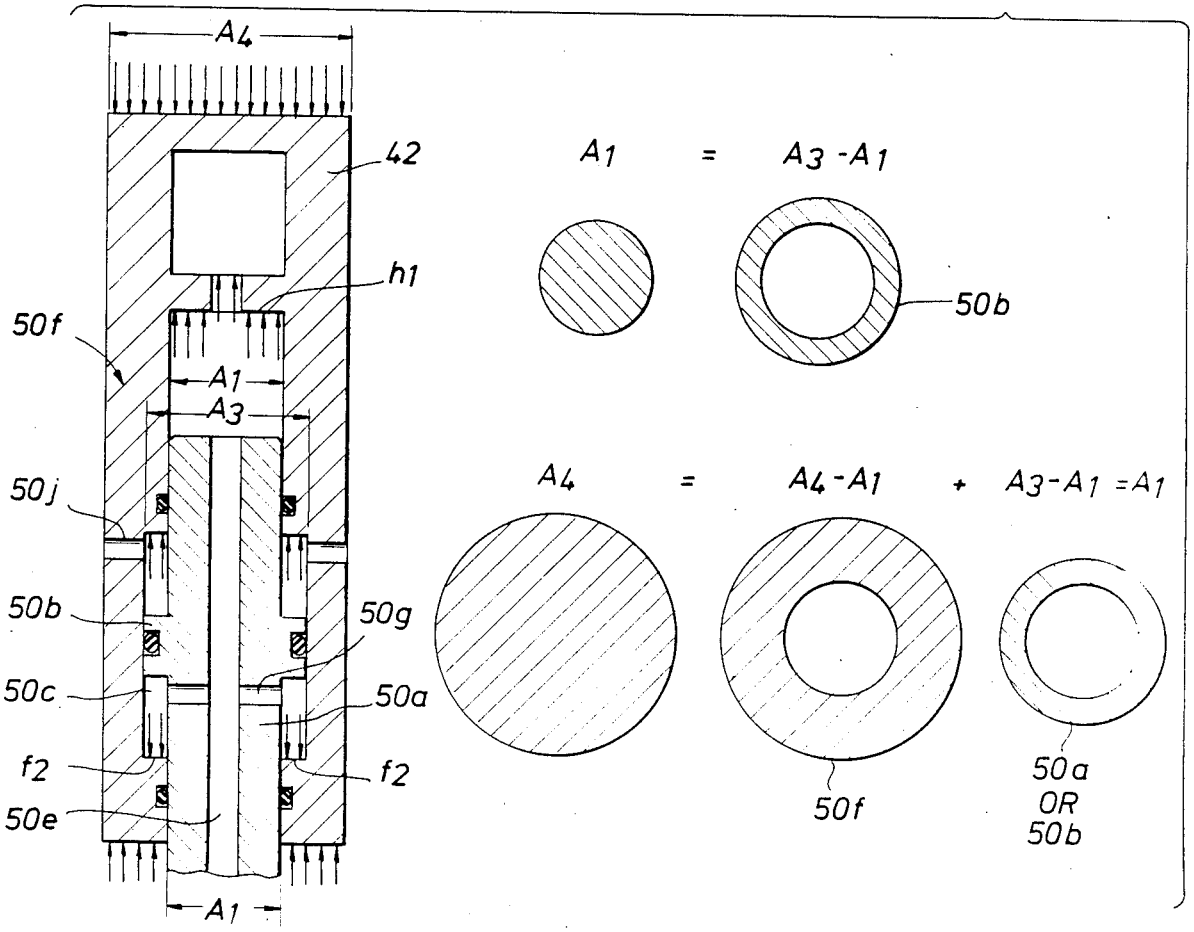
FIG. 12 illustrates a recorder carrier including the balance joint of FIGS. 8, 10*a*/10*b* and its basic principle of operation in accordance with one embodiment of the present invention.

Referring to FIG. 12, the balance joint 50 of FIG. 8, 10a and 10b is again illustrated, this figure illustrating the cross sectional areas of the balance joint, the cross sectional areas being important in order to allow the balance joint 50 to adequately perform its intended function. In FIG. 12, a well fluid 48g enters hollow interior 5Oe of the mandrel 50a and flows into annular area 50c via port 50g, the well fluid 48g exerting its pressure on upper working surface f2 of enlarged end portion 50f1 of balance housing 50f. The well fluid 48g tends to move the balance housing 50f from top to bottom in the figure, as indicated by the force/pressure arrows on working surface f2. In the meantime, annulus fluid is exerted on other areas of the balance housing 50f, and tend to move the balance housing 50f from bottom to top in the figure. Annulus fluid enters the balance joint 50 via port 50j in FIG. 12. It is important to understand the relationship between the different cross sectional areas within the balance joint: Area A4 representing the cross sectional area of the entire balance joint 50; Area A1 representing the cross sectional area of the mandrel 50a which also happens to be the cross sectional area of surface h1; and Area A3 representing the cross sectional area of the combination mandrel 50a and piston 50b. These cross sectional areas (A4, A1, and A3) are related to one another in accordance with the following arithmetical relationships:

$$A1=A3-A1 \quad (1)$$

$$A4=(A4-A1)+(A3-A1) \quad (2)$$

Since (A3−A1) is equal to A1, the following further relationship is true:

$$A4=(A4-A1)+(A1) \quad (3)$$

The most important one of these arithmetical relationships is equation (1), $A1=A3-A1$. Referring to FIG. 12, Area A1 represents the cross sectional area of the mandrel 50a as well as the cross sectional area of surface h1; whereas Area (A3−A1) represents the cross sectional area of the annular surface of piston 50b.

By definition, in accordance with equation (1) above, the recorder carrier of the present invention has purposely been designed such that the cross sectional area of the annular surface of piston 50b (A3−A1) is equal to the cross sectional area of the mandrel 50a and also of the surface h1 (A1). However, by reference to FIG. 12, the cross sectional area (A3−A1) of piston 50b is equal to the cross sectional area of the working surface f2 of enlarged portion 50f1 of balance housing 50f. Therefore, the cross sectional area of working surface f2 must be equal to the cross sectional area (A1) of surface h1.

Since the cross sectional area of working surface f2 is equal to the cross sectional area (A1) of surface h1, any well fluid pressure forces being exerted on surface h1 will be "cancelled out" by the well fluid pressure forces being exerted on working surface f2 of the enlarged portion 50f1 of the balance housing 50f. Therefore, in effect, there is no "net" force being placed on surface h1 in FIG. 12 due to well fluid pressure. Consequently, the recorder 42 will not move in response to well fluid pressure and the recorder 42 will not tend to "bottom out" the shock mount 46 shown in FIG. 6.

A description of the functional operation of the balance joint 50 will be set forth in the following paragraph with reference to FIGS. 8, 10a/10b, and 12.

The well fluid 48g enters channel 48f of over pressure gauge protector 48 (FIG. 7) and the hollow interior 50e of the mandrel 50a. The well fluid 48g then enters ports 50g; the well fluid pressure is exerted on the working surface f2 of the enlarged portion 50f1 of balance housing 50f. Remembering that the balance housing 50f is threadedly connected to a recorder (either recorder 42 or 44), the well fluid pressure on the working surface f2 tends to pull the recorder downwardly in the FIG. 8. However, the well fluid 48g also flows into the internal chamber 50i, the well fluid 48g pressure being exerted on a surface h1 of the recorder 42 in FIG. 8. This pressure tends to push the recorder 42 upwardly in FIG. 8. Since the recorder 42 is connected to the shock mount 46, the well fluid pressure being exerted on surface h1 tends to push the recorder 42 upwardly to a point where the shock mount 46 "bottoms out". However, while the well fluid pressure on surface h1 tends to push the recorder 42 upwardly in the FIG. 8, the well fluid pressure being exerted on working surface f2 of the enlarged portion 50f1 of balance housing 50f tends to pull the recorder 42 downwardly in the FIG. 8. Since the cross sectional areas $A1=A3-A1$, as described above, the recorder 42 fails to move in either direction. However, note that the only recorder movement which is "cancelled out" is that movement which is a result of the well fluid pressure being exerted on the recorder 42. The movement of recorder 42 in response to mechanical shock vibrations originating from a perforating gun following detonation is not cancelled out by the balance joint 50.

Figure 9:
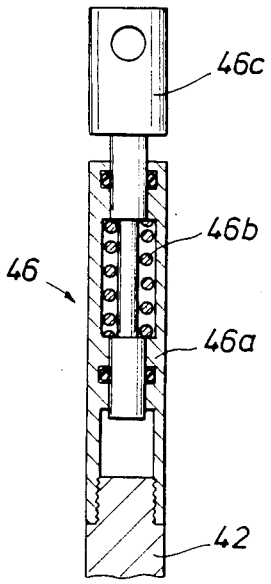
FIG. 9 (PRIOR ART)
FIG. 9 illustrates the shock mount of FIG. 6.

Referring to FIG. 9, a prior art shock mount 46 used in connection with the FIG. 6 embodiment of the recorder carrier of the present invention is illustrated. The shock mount 46 is very similar to the shock absorber shown in the prior art FIG. 3 of the drawings, and includes a shock mount housing 46a and a coiled spring 46b which biases the shock mount housing 46a against a stop 46c. When a mechanical shock is received from a detonated perforating gun, the housing 46a abuts against the stop 46c, and the spring 46b begins to compress, absorbing the mechanical shock.

Figure 14:
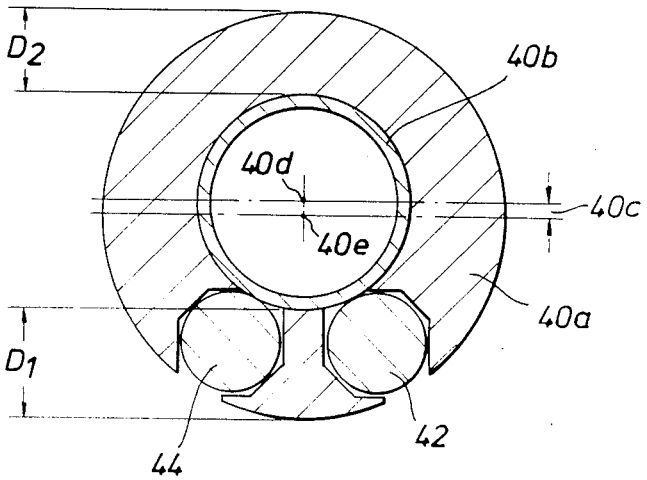
FIG. 14 illustrates a cross section of the subject recorder carrier taken along section lines 14—14 of FIG. 6.

Referring to FIG. 14, a cross sectional view of the recorder carrier 40 of FIG. 6, taken along section lines 14—14 of FIG. 6, is illustrated.

In FIG. 14, the recorder carrier 40 cross section includes an outer body 40a and an inner tube 40b. Two recorders 42 and 44 are housed in the outer body 40a. The outer diameter of the outer body 40a is offset by approximately 0.15 inch from the inner tube 40b, as shown by numeral 40c. The center of the inner tube 40b is located at a first point 40d and the center of the outer body 40a is located at a second point 40e, the second point 40e being offset along the Y-axis from the first point 40d by approximately 0.15 inch.

As a result of the offset in first and second points 40d and 40e, dimension D1 is greater than dimension D2 in FIG. 14. Therefore, additional space is available within the outer body 40a for placement therein of the recorders 42 and 44. The offset center arrangement as above described provides the space required to mount 1¼ inch outer diameter (OD) gauges (recorders) without increasing the OD of the recorder carrier 40 to more than 5 inches; as a result, adequate clearance between the inner diameter of the casing and the outer diameter of the recorder carrier is provided for fishing the recorder carrier 40 out of the borehole in the event the tubing string parts into two pieces near the recorder carrier while disposed downhole.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A recorder carrier adapted to be included within a well tool, the carrier adapted to include at least one recorder, the recorder being movable within said recorder carrier when said carrier includes the recorder, the well tool adapted to be disposed in a borehole containing well annulus fluid, the recorder carrier adapted to receive well fluid from a formation in said borehole, comprising:

overpressure protection means for preventing said well fluid from entering said recorder carrier when a pressure of said well fluid is greater than a predetermined amount above a pressure of said well annulus fluid thereby protecting said recorder from said pressure of said well fluid.

2. The recorder carrier of claim 1, further comprising:

balance means connected to said overpressure protection means for receiving said well fluid from said overpressure protection means when said pressure of said well fluid is less than or equal to said predetermined amount and for preventing any substantial movement of said recorder in said recorder carrier in response to a pressure of said well fluid received from said overpressure protection means.

3. The recorder carrier of claim 2, further comprising:

an outer body having a central longitudinal axis; and an inner body having a central longitudinal axis and being surrounded by said outer body, the central axis of the outer body being offset in relation to the central axis of the inner body so as to define a first space between the circumferences of said inner and outer bodies on one side of said inner body and a second space between the circumferences of said inner and outer bodies on the opposite side of said inner body, said first space being greater than said second space, said recorder being disposed in said outer body and within said first space.

4. The recorder carrier of claim 2, wherein said balance means further comprises:

a mandrel having a hollow interior adapted to receive said well fluid;

a housing disposed around and slidable with respect to said mandrel, said housing including a wall portion and an enlarged end portion connected on one end to one end of said wall portion and contacting and sealingly engaging on the other end an outer periphery of said mandrel thereby defining an annular area between said outer periphery of said mandrel and an inner side of said wall portion; and a port disposed through said mandrel communicating said hollow interior with said annular area, a portion of a flow of said well fluid being diverted into said port and into said annular area when said well fluid is received in said hollow interior of said mandrel, said portion of said flow impacting said enlarged end portion of said housing.

5. The recorder carrier of claim 4, wherein said recorder is connected to the other end of said wall portion, a remaining portion of said flow of said well fluid impacting said recorder when said well fluid is received in said hollow interior of said mandrel, and a force on said enlarged end portion resultant from said portion of said flow of said well fluid impacting said enlarged end portion cancelling out a force on said recorder resultant from said remaining portion of said flow of said well fluid impacting said recorder.

6. The recorder carrier of claim 1, wherein said overpressure protection means further comprises:

a mandrel, a second port being disposed through one end of said mandrel;

a piston connected to said mandrel; and an outer housing surrounding said mandrel and said piston, a first channel being disposed through said housing, said overpressure protection means being adapted to receive said well fluid from said formation when said well tool is disposed in said borehole and allowing said well fluid to enter said recorder carrier in said well tool via said second port in said mandrel and said first channel in said outer housing when said second port is in alignment with said first channel.

7. The recorder carrier of claim 6, wherein said overpressure protection means further comprises:

a first port disposed through another end of said mandrel; and a third port being disposed through another part of said housing, one end of said housing contacting and sealingly engaging said mandrel and defining a first space between said mandrel and said housing on one side of said piston, the other end of said housing contacting and sealingly engaging said mandrel and defining a second space between said mandrel and said housing on the other side of said piston, said first port allowing said well fluid to flow into said first space and impact said one side of said piston when said well fluid is received in said overpressure protection apparatus, said third port allowing said annulus fluid to flow into said second space and impact the other side of said piston when said well tool is disposed in said borehole.

8. The recorder carrier of claim 7, wherein said overpressure protection means further comprises:

biasing means disposed in said second space for providing a biasing force on said other side of said piston.

9. The recorder carrier of claim 8, wherein said second port moves out of alignment with said first channel thereby preventing said well fluid from entering said recorder carrier when a first force on said one side of said piston resultant from the impact of said well fluid on said one side of said piston is greater than a second force on said other side of said piston resultant from said biasing force in addition to the impact of said annulus fluid on said other side of said piston.

10. The recorder carrier of claim 9, further comprising:

balance means connected to said overpressure protection mean for receiving said well fluid from said overpressure protection means when said pressure of said well fluid is less than or equal to said predetermined amount and for preventing any substantial movement of said recorder in said recorder carrier in response to a pressure of said well fluid received from said overpressure protection means.

11. The recorder carrier of claim 10, wherein said balance means further comprises:

a mandrel having a hollow interior adapted to receive said well fluid;

a housing disposed around and slidable with respect to said mandrel, said housing including a wall portion and an enlarged end portion connected on one end to one end of said wall portion and contacting and sealingly engaging on the other end an outer periphery of said mandrel thereby defining an annular area between said outer periphery of said mandrel and an inner side of said wall portion; and a port disposed through said mandrel communicating said hollow interior with said annular area, a portion of a flow of said well fluid being diverted into said port and into said annular area when said well fluid is received in said hollow interior of said mandrel, said portion of said flow impacting said enlarged end portion of said housing.

12. The recorder carrier of claim 11, wherein said recorder is connected to the other end of said wall portion, a remaining portion of said flow of said well fluid impacting said recorder when said well fluid is received in said hollow interior of said mandrel, a force on said enlarged end portion resultant from said portion of said flow of said well fluid impacting said enlarged end portion cancelling out a force on said recorder resultant from said remaining portion of said flow of said well fluid impacting said recorder.

13. A recorder carrier adapted to be included within a well tool comprising: a carrier adapted to include at least one recorder, said recorder being movable within said recorder carrier when said carrier includes the recorder, the recorder carrier adapted to receive well fluid from a formation in a borehole; and balance section means for receiving said well fluid and preventing any substantial movement of said recorder in said recorder carrier in response to a pressure of the received well fluid.

14. A recorder carrier adapted to include at least one recorder, the recorder carrier adapted to be included within a well tool, comprising:

an outer body having a central longitudinal axis; and an inner body having a central longitudinal axis and being surrounded by said outer body, the central axis of the outer body being offset in relation to the central axis of the inner body so as to define a first space between the circumferences of said inner and outer bodies on one side of said inner body and a second space between the circumferences of said inner and outer bodies on the opposite side of said inner body, said first space being greater than said second space, said recorder being disposed in said outer body and within said first space.

* * * * *